United States Patent [19]

Sheppard et al.

[11] Patent Number: 4,585,232

[45] Date of Patent: Apr. 29, 1986

[54] AUTOMOBILE BOARD GAME HAVING UNIQUE COLOR CODE DICE

[76] Inventors: Lisa K. Sheppard; Douglas Darnell, both of 671 Cimarron St., Springfield, Va. 22150

[21] Appl. No.: 622,972

[22] Filed: Jun. 21, 1984

[51] Int. Cl.[4] ..... A63B 3/00

[52] U.S. Cl. ..... 273/248; 273/146; 273/256

[58] Field of Search ..... 273/248, 249, 246, 250, 273/251, 252, 254, 256, 243, 146, 253, 257, 255

[56] References Cited

U.S. PATENT DOCUMENTS

| | | | |
|---|---|---|---|
| 1,310,390 | 7/1919 | Clark | 273/248 |
| 1,574,394 | 2/1926 | Holme | 273/252 |
| 2,239,779 | 4/1941 | Clark et al. | 273/254 |
| 3,433,483 | 3/1969 | Ellis | 273/248 |
| 3,642,286 | 2/1972 | Moore | 273/146 |
| 4,087,094 | 2/1978 | Bakay | 273/254 |

FOREIGN PATENT DOCUMENTS

| | | | |
|---|---|---|---|
| 196439 | 4/1923 | United Kingdom | 273/249 |

*Primary Examiner*—Richard C. Pinkham
*Assistant Examiner*—Matthew L. Schneider
*Attorney, Agent, or Firm*—Dennis H. Lambert

[57] ABSTRACT

A board game simulating various aspects of automobile ownership and operation. The game comprises a board subdivided into several distinct playing paths or areas, including a path extending around the perimeter of the board with spaces representing detriment to the player and spaces representing benefit to the player, and areas or paths spaced inwardly of the perimeter, representing home bases or towns of the players, and with spaces involving detriment and/or benefit to the player. Each inner playing area or town includes a bank at which car payments may be made. A plurality of playing pieces are provided for each player for movement along the playing paths, the pieces preferably representing small, medium and large automobiles. Movement of the playing pieces is controlled by a combination of chance and skill or strategy, and is governed by the use of a pair of multi-colored dice which are cast or rolled to determine which playing piece or pieces are moved, and the extent of movement. Play variation cards corresponding to the various spaces on the board are provided to govern play according to the instructions on the cards. The first player to obtain title to all of his playing pieces and to return to his home base is the winner.

13 Claims, 11 Drawing Figures

FIG 1
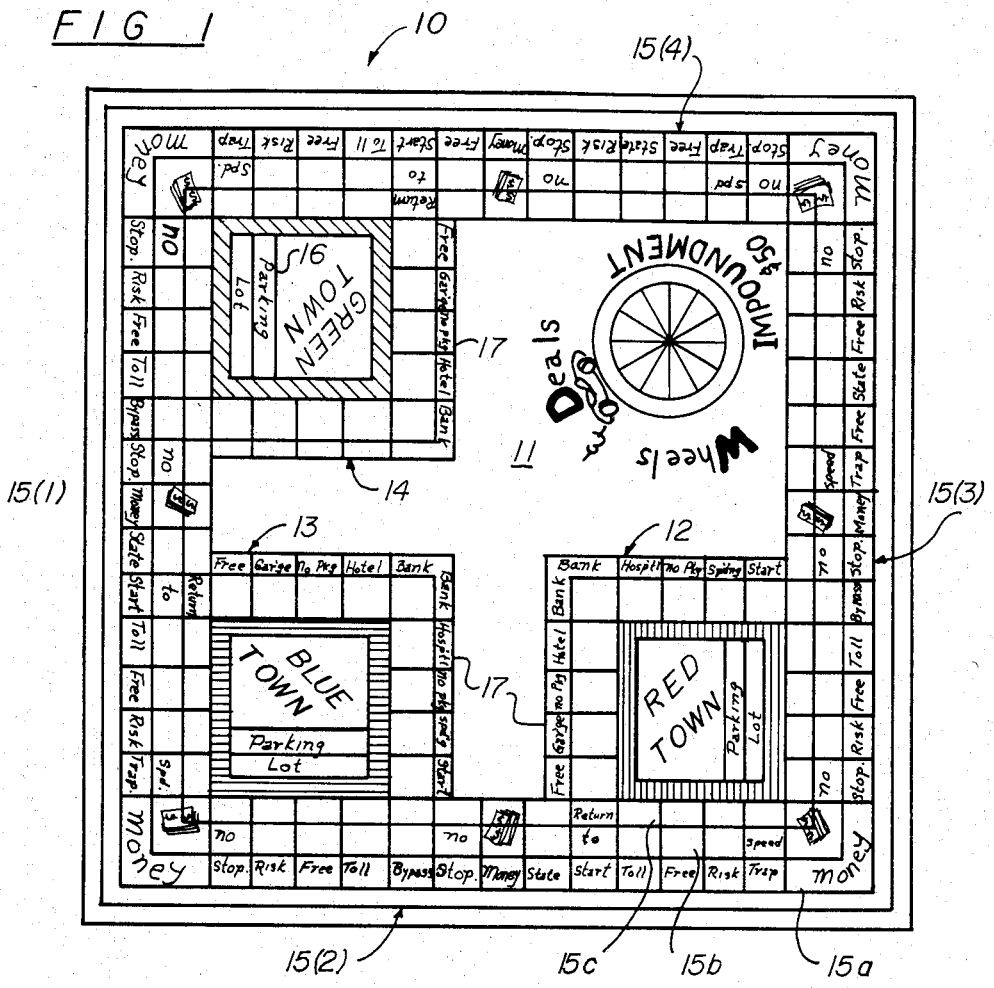
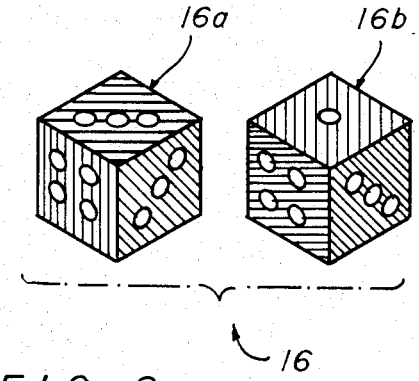
FIG 2
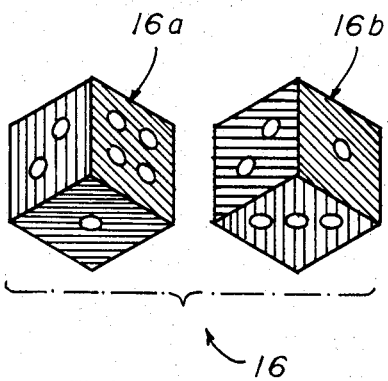
FIG 3

FIG 4
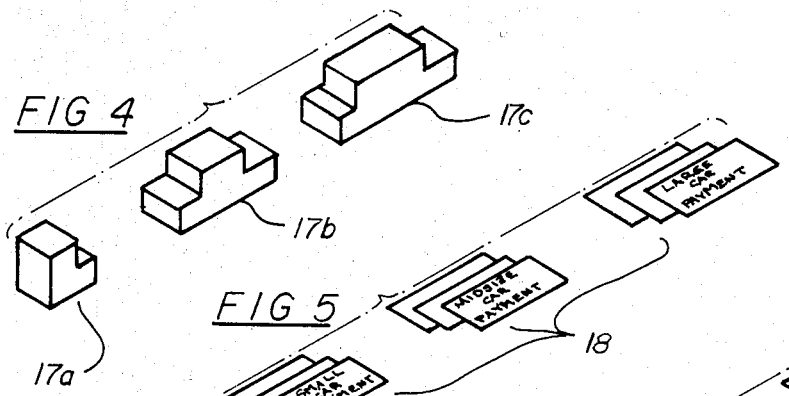
FIG 5
FIG 6
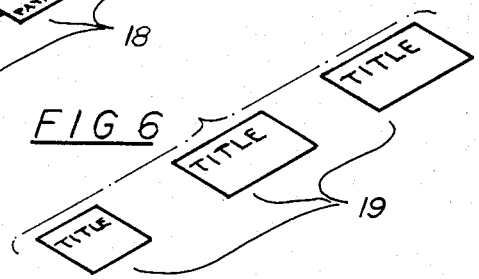
FIG 7
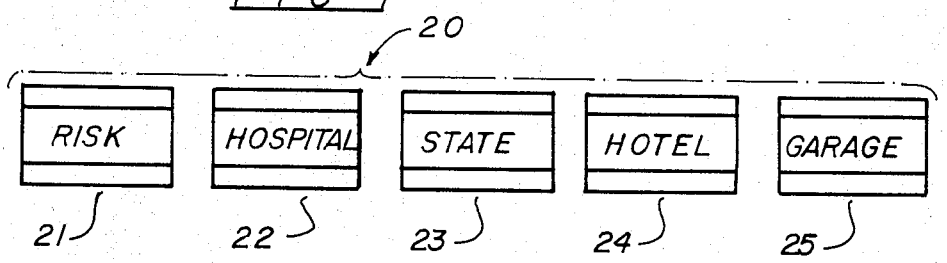
FIG 8
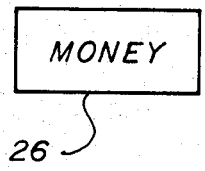
FIG 9
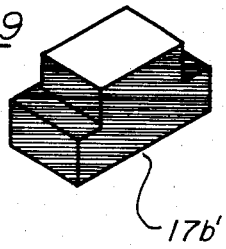
FIG 11
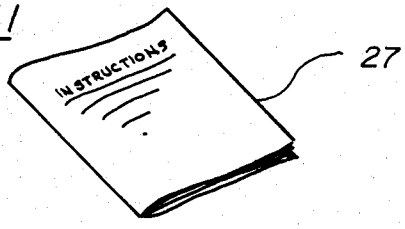

AUTOMOBILE BOARD GAME HAVING UNIQUE COLOR CODE DICE

BACKGROUND OF THE INVENTION

1. Field of the Invention

This invention relates to games. More particularly, the invention relates to a board game which simulates automobile ownership and operation.

2. Prior Art

Many varieties of board game apparatus are known for simulating such diverse activities as racing, sailing, medicine touring, etc. The following patents are examplary of such games: U.S. Pat. Nos. 895,128, 1,574,394, 1,627,501, 4,040,628, 4,049,274, 4,087,094, 4,136,879, 4,216,966, 4,279,422, 4,357,017 and 4,34,984. At least one of these patents, U.S. Pat. No. 1,574,394, discloses a board game for simulating touring with an automobile and includes starting positions or homes for each player and a peripheral path along which each player progresses by rolling dice until that player returns to his starting position. The first player to return to his starting position is the winner of the game. Various spaces along the path of travel represent setbacks to the player, delaying his return to the starting point.

None of the prior art known to applicants describes a board game for simulating automobile ownership and operation in which each player has a starting point represented by a "home town" for that player, and in which a path of play is defined by the home town, with a peripheral path of play extending around the board, and wherein movement of color-coded playing pieces along the paths of play is controlled by rolling a pair of color-coded dice for determining not only which playing piece can be moved but also the extent of movement of that playing piece. Further, none of the prior art known to applicants discloses an automobile board game in which money may be gained or lost as the playing piece is advanced along the paths of play, and wherein winning the game is achieved by paying for and obtaining title to all of the playing pieces belonging to a particular player and returning all of those playing pieces to the starting point.

The prior art games, including U.S. Pat. No. 1,574,394, merely involve the movement of the playing pieces along the designated paths of travel, with various hazards presented to such advancement, including side trips to road houses, camping areas, police stations, etc., and do not include any means representative of financial gain or loss, and particularly of any means for obtaining title to the playing pieces. These games thus do not simulate the pecuniary aspects of automobile ownership and operation.

SUMMARY OF THE INVENTION

Accordingly, it is a principal object of this invention to provide a board game which simulates the pecuniary aspects of vehicle ownership and operation.

Another object of the invention is to provide a board game in which a plurality of separate and distinct playing areas or paths are defined, including a number of inner playing areas representative of home bases for players and a peripheral playing area extending around the inner playing areas, and in which movement of playing pieces along the playing areas is controlled by rolling a pair of dice having at least two different types of indicia thereon.

A more specific object of the invention is to provide a board game for simulating automobile ownership and operation, in which movement pieces are moved along paths of play having spaces representing pecuniary gain and pecuniary loss to the player, and in which the game is won by the player who first pays for and obtains title to all of his playing pieces and returns them to his home base.

These and other objects and advantages of the invention are accomplished by a board game apparatus in which a game board has a plurality of separate and distinct playing areas designated thereon, including a peripheral playing path extending around the perimeter of the board and a plurality of separate and distinct inner playing paths spaced inwardly from the peripheral playing path, each playing path being divided into a plurality of movement spaces variously representing benefit or detriment to the player, and wherein the inner playing paths represent home bases for the players. Each home base or inner playing area is distinctively marked for each player and includes a bank at which payments may be made on the playing piece of that player. Each player has a plurality of playing pieces or movement pieces for movement along the paths of play, the movement pieces being distinctively marked for each player. Movement of the movement pieces is controlled by rolling a pair of dice having two different types of indicia thereon, e.g. spots and color, whereby both the identity of the movement piece and the extent of movement thereof are determined. A plurality of play variation cards having indicia thereon corresponding to at least some of the movement spaces and having directions thereon are provided for governing the benefit or detriment to be accorded a playing piece resting on a designated movement space.

BRIEF DESCRIPTION OF THE DRAWINGS

A more complete understanding of the present invention will become apparent from the following detailed description and accompanying drawings, wherein like reference characters designate like parts throughout the several views, and wherein:

FIG. 1 is a top plan view of a game board in accordance with the invention;

FIG. 2 is a top front perspective view of a pair of dice for use in the game of the present invention;

FIG. 3 is a bottom rear perspective view of the dice of FIG. 2;

FIG. 4 is an exploded perspective view of a set of movement or playing pieces for a player;

FIG. 5 is an exploded perspective view of a set of payment cards which accompany the playing pieces of FIG. 4;

FIG. 6 is an exploded perspective view of playing cards representing titles to the playing pieces of FIG. 4;

FIG. 7 is a collective view of the various play variation cards used in the game of the invention;

FIG. 8 is a top plan view of money cards used in the game of the invention;

FIG. 9 is a top perspective view of a modified playing piece or movement piece;

FIG. 11 is a perspective view showing a set of instructions for the game of FIG. 1.

DESCRIPTION OF THE PREFERRED EMBODIMENTS

Figure 10:
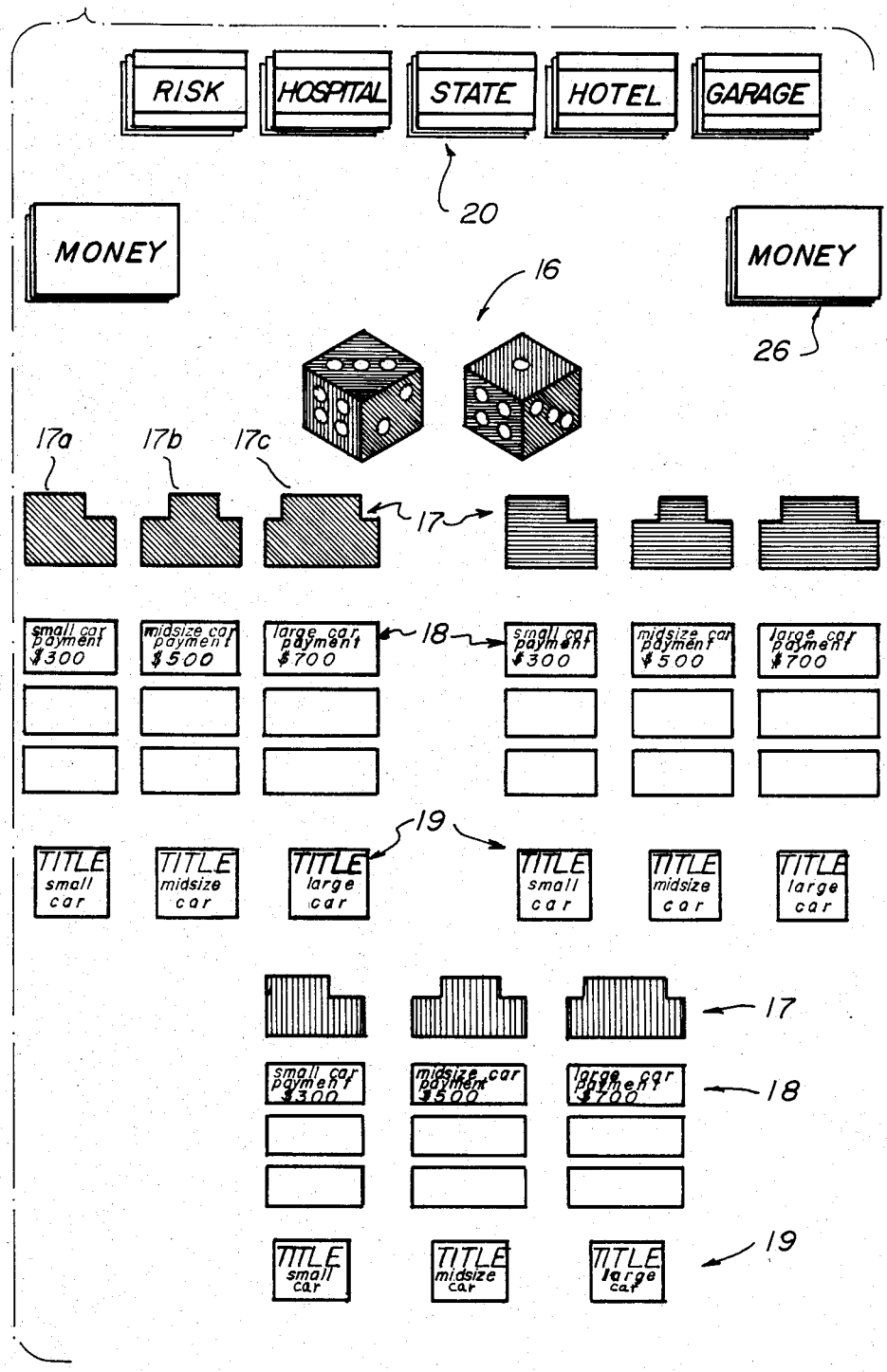
FIG. 10 is a collective view of the various movement pieces, playing cards and dice used in the game of the invention.

Referring more particularly to the drawings, a game board in accordance with the invention is shown at 10 in FIG. 1 and has a playing surface 11 with a plurality of separate and distinct inner playing areas 12, 13 and 14 and a peripheral playing area 15 designated thereon.

Each inner playing area represents a home town or base for a player and comprises a parking lot 16 and a playing path 17 divided into a plurality of spaces designated as "start", "speeding", "hospital", "bank", "hotel", "garage", "free" and two spaces marked "no parking". Each home town or base 12, 13 and 14 is further distinguished by a color, such as red, blue, and green, respectively, and are located in three adjacent corners of the board. The remaining corner of the board has indicia therein representing an impoundment lot 18.

The peripheral playing area 15 comprises three parallel rows of spaces, with the outermost row 15*a* carrying descriptive words designating the nature of the adjacent spaces in the two innermost rows 15*b* and 15*c*, which comprise a playing path for movement of the movement pieces around the board. The spaces in the two legs 15(1) and 15(2) extending along the sides of the board adjacent the inner playing areas 12, 13 and 14 (the left hand side and bottom of the board as seen in FIG. 1) are identically designated, beginning with the space at the extreme left end of each leg, and are designated as follows "money", "no stopping", "risk", "free", "toll", "bypass", "no stopping", "money", "state", "return to start", "toll", "free", "risk" and "speed trap". The other two legs 15(3) and 15(4) of the peripheral playing area (the right hand side and the top of the board as viewed in FIG. 1) are differently designated. Thus, leg 15(3) begins with the space marked "money" in the bottom or left end thereof and continues with "no stopping", "risk", "free", "toll", "bypass", "no stopping", "money", "speed trap", "free", "state", "free", "risk" and "no stopping". Leg 15(4), viewed from the top of the board, begins with "money" and continues through "no stopping", "speed trap", "free", "state", "risk", "no stopping", "money", "free", "return to start", "toll", "free", "risk" and "speed trap".

It will be noted that a space designated "money" is located every seven spaces around the periphery of the board, and that there are seven spaces between each "bank" position in the inner playing areas and adjacent "money" spaces in the peripheral playing path. Moreover, the space in the peripheral path located adjacent the "start" position of each inner playing area is designated "bypass", while the space in the peripheral path adjacent the exit from each inner playing area is designated "return to start". Accordingly, once a playing piece lands on one of the spaces marked "money" or "bank", it is desireable to roll a seven with the dice thereafter so that the player can continue to receive money and make payments on his playing piece. When moving from "bank" to "money", the player must roll his double color. It should be noted that the highest number which can be rolled in a double color is, in fact, a seven. Also, if it is desired to avoid an inner playing area or town, it is necessary to land on the space marked "bypass".

In addition to the game board 10, and as shown best in FIG. 10, the game includes a pair of dice 16, with each die 16*a* and 16*b* of the pair having three different colors on opposite panels or surfaces thereof. In the embodiment shown, the colors are red, blue and green. On die 16*a* the red panels have one spot and three spots, respectively, the green panels have one spot and three spots, respectively, and the blue panels have two spots and four spots, respectively. On die 16*b*, the red and green panels each carry two spots and four spots, respectively, while the blue panels carry one spot and three spots, respectively. Thus, one die of the pair has the even numbers of spots for a particular color, while the other die has the odd numbers of spots for that color. Further, it will be noted that the highest number which can be rolled with the two dice is an eight.

There are six sets of three playing pieces or movement pieces each, with each set 17 including a piece 17*a* representing a small car, a piece 17*b* representing a mid-size car and a piece 17*c* representing a full size or luxury car. It will be observed in FIG. 10 that the movement pieces in three of the sets are of uniform color, while the movement pieces in the remaining three sets are two-tone.

Each movement piece is accompanied by three payment cards 18, the small car payment cards 18*a* each representing a payment of $300, the mid-size car payment cards 18*b* each representing a payment of $500, and the full size car payment cards each representing a payment of $700.

Similarly, each movement piece is accompanied by a card 19 representing title to that movement piece.

In addition, there are five groups or categories of play variation cards 20, including fifteen cards 21 designated "Risk", fifteen cards 22 designated "Hospital", fifteen cards 23 designated "State", fifteen cards 24 designated "Hotel" and fifteen cards 25 designated "Garage". Each card in each group has a different instruction printed on the rear side thereof as follows:

RISK (1) Car insurance due. Pay 10% of car value.
(2) Go to the nearest vacant Garage.
(3) You may or may not be lucky. Return to your own start.
(4) Here's a real risk! Roll the dice to see if you pay or get paid. Even numbers pay you 100 times the number indicated by the dice; odd numbers, you pay 100 times.
(5) Due to an accident you were involved in, you owe the owner of the car nearest in front of you on the perimeter 100 times the number on the dice. If two cars are side by side, split the money between both owners. *Void if no cars are on the perimeter.
(6) One free bank payment.
(7) You are overdrawn on your bank account. Please deposit $250.
(8) Advance to the nearest vacant "Money" space. Roll the dice and collect 100 times the number on the dice.
(9) Insurance check from accident pays you. Roll dice and collect 100 times the number on the dice.
(10) Go to the nearest vacant Hotel.
(11) Your lucky day! Advance to the nearest vacant Bank and collect $300.
(12) So you took a risk. Try your luck at this one. Roll the dice. A double color pays you 100 times the number on the dice. Otherwise, you pay 100 times the number on the dice.
(13) Go to the nearest vacant Hospital.
(14) Go to the nearest vacant Bypass.

(15) Keep this card! Get out of Impoundment free. *When leaving Impoundment, return to your own Start.

GARAGE (1) Your tires are low. Get some air.
(2) New battery—$85.00.
(3) It's time again for your oil change and lube—$25.
(4) Your new carburetor costs you $125.
(5) One quart of oil—$1.00.
(6) Replace broken windshield—$100.
(7) Sorry! You need a new engine—$1,000.
(8) Time for a tune-up—$75.
(9) One free tank of gas.
(10) One free oil change.
(11) The part to fix your car won't come until tomorrow. You must return to the Hotel.
(12) Oh no! Transmission job—$500.
(13) Blown fuse—$1.00.
(14) Fill gas tank: small car—$10; mid-size car—$15; luxury car—$25.
(15) New tires: small car—$100; mid-size car—$200; luxury car—$300.

HOTEL (1) One night's stay—$50.
(2) One night's stay—$50.
(3) One night's stay—$50.
(4) One night's stay—$50.
(5) One night's stay—$50.
(6) Two night's stay—$100.
(7) One night's free stay.
(8) Hope you enjoyed your week's stay with us. Sorry the maids were on strike. $275.
(9) It's a long week-end. Enjoy your stay! $100.
(10) Just a quick cup of coffee—$1.00.
(11) Bellhop lost your luggage. Hotel refunds to you $200.
(12) FIRE! Leave town at once. Go to the nearest Free space.
(13) One week's stay with a maid—$350.
(14) Caught stealing towels! $500.
(15) You get a refund. No towels in your room. $25.

HOSPITAL (1) Medical check-up. $150.
(2) Emergency care. $150.
(3) Emergency surgery. $500.
(4) Medical consultation. $75.
(5) One paid Hospital bill.
(6) Hospitalization Insurance. $100.
(7) Due to an accident, you have received a back injury. $700.
(8) Health insurance refund. $200.
(9) Lab work. $200.
(10) X-rays needed due to an accident. $50.
(11) Due to a rear end collision, you now have a neck injury. $400.
(12) You took a fall getting out of your car and broke your arm. $250.
(13) Caught your finger in the car door. Broken finger! $85.
(14) You kicked the tires on your car and broke your toe. $125.
(15) While jacking up your car to change a tire, the jack broke and the car fell on your leg. Broken leg! $350.

STATE (1) Non-insured motorist fee. $250.
(2) You hit a guard rail, and have been charged with destruction of State property. $250.
(3) The State has charged you with reckless driving. Please pay $250.
(4) State inspection. $10.
(5) It's time to renew your driver's license. $15.
(6) Dead inspection sticker. $25.
(7) Your car was abandoned and towed to Impoundment. Pay $50.
(8) Speeding fine. Roll again and pay ten times the number on the dice.
(9) You've been charged with speeding. Pay ten times the number on the dice.
(10) Dead county sticker. $25.
(11) Personal Property Tax due. Pay 10% of car value.
(12) Speeding fine. Roll again and pay ten times the number on the dice.
(13) You hit a Police car. Pay for damages—100 times the number on the dice.
(14) You hit a stop sign. $100.
(15) Dead tags. $50.

In addition, scrip 26 representing money is provided with the game, along with a set of instructions 27.

To play the game, the board 10 is placed on any flat surface, and the play variation cards 21 through 25 are placed face down on a convenient surface so that all players may reach them. Each player receives three movement pieces or cars 17*a*, 17*b* and 17*c* of the same color, and three payment cards 18 for each car. Further, each player receives scrip 26 equivalent to $2,000 as follows: three $500 bills; three $100 bills; two $50 bills; two $20 bills; four $10 bills; three $5 bills and five $1 bills.

One player is selected to act as title holder and banker. This player is responsible for all financial transactions, including money paid to the Bank by players in accordance with instructions on the play variation cards 20, money for impoundment fees and all car payments. When a player makes a car payment, that player gives the "Banker" one color coded payment card 18 per payment. When all three payments have been made on a car, the banker delivers to that player one color coded title card 19. The title cards 19 are placed in that players designated color coded town, so that all players will be aware of each other's progress in the game.

There is a Bank in each town, where all car payments must be made. A player may make a car payment at any of the three Banks if the car for which a payment is to be made is located in the Bank space. A player does not have to make a car payment when he has a car at the Bank, or he may choose to make any or all three payments due on that car.

To start the game, each player chooses a color and then places one of his cars in the Parking Lot of each color coded Town. The color chosen by each player represents that player's "Home Town". One of the dice 16 is then rolled by each player, with the highest number rolled determining the player to move first. The players then move sequentially in a clockwise direction.

In order for a player to move his car to the Start position or space, he must roll the color for the respective town. For example, if a player rolls the dice and the sides colored blue and green are disposed in an up position, the player may move the cars in the towns colored blue and green to the Start position. If on his next turn, this player rolls a red 2 and a green 4, he must place the car in the red Town on the Start space and he must then move the car in the green Town the indicated four spaces. While in any color Town, if that Town's color is rolled, the player must move the car in that Town the indicated number of spaces.

Only two cars may occupy one space at the same time, and a player may not pass any space occupied by two cars.

If a player rolls a double color, i.e. the same color appears on both dice, and that color is that player's color, the player is entitled to another move. Moreover, if the player lands on a space marked "Money", he must roll the dice and collect 100 times the amount shown by the dice. If a double color is rolled, the player collects 200 times the amount shown by the dice. However, if the player has drawn a card instructing him to roll the dice and collect 100 times the amount shown by the dice, he does not collect twice this amount if he rolls a double color.

If a player lands on a space marked "Speeding", he must roll the dice and pay ten times the count of the dice. If the player lands on a space marked "No parking", he must pay a $10 fine. If the player lands on any of the spaces marked "Hotel", "Hospital" or "Garage", he must draw a card and do as directed by that card. There are several "Free" spaces on the board where a player can land without incurring any obligation. Similarly, if the player lands at a space marked "Bank" and does not wish to make a car payment, this space then constitutes a "free" space.

A player must attempt to reach the perimeter of the board so that he will have an opportunity to collect money, since he only receives $2,000 at the start of the game and the cost of all of his cars totals $4,500. As noted previously there are seven spaces between the spaces marked "Money" and a player obviously tries to roll this number when he is on either a "Money" or "Bank" space. Once a player reaches the perimeter, he may move freely on any color he rolls as long as he does not have a car in the town of the color he rolls.

When a player lands on a "Return to start" space, he must return to the start of that player's color town. When the player lands on a space marked "No stopping", he must go directly to "Impoundment", and when he lands on a space marked "State", he must draw a "State" card and do as directed by that card. Similarly, when landing on a space marked "Risk" the player draws a "Risk" card and does as directed by that card. If the player lands on one of the spaces marked "Bypass" he may continue on the perimeter and need not enter the adjacent town. If he does not land on a "Bypass" space, he must enter the town. If the player lands on space marked "Speed Trap", he must roll the dice and pay ten times the count of the dice.

When a player encounters a "road block" caused by two cars occupying the same space, he is prohibited from passing unless directed to do so by one of the play variation cards, and must forfeit that part of the move affected by the road block.

In some circumstances, a player has an option in connection with the move he will make. For instance, at the start of the game, if a player rolls a double color he may move his car in that color town to the start position and then move that car the full count of one of the dice. Any time a player has more than one car in a town and he rolls that double color, he may split the move between the cars, moving each of two cars the full count of a respective one of the dice. Anytime a player has a car in one of the towns and he rolls that color, he must move that car the full count of the die showing that color.

If a player moves two cars on any given turn and the cars land on a space or spaces that are the same, he must draw a card for each car. In other words, the player must follow directions for both cars. In this connection, if the player should move two cars and land on a space marked "Money" and a space marked "Speeding", for example, he must roll for the speeding fine first, and then roll for the money space. The player must always roll for a penalty before rolling for money.

Any time a player is directed to go to "Impoundment", he must pay a $50 fee upon entering the impoundment lot. There are only two ways to get out of impoundment. The first way is to use one turn to roll one die in an effort to roll the color of the player. If the player has two or more cars in impoundment, he may roll two dice. The only other way to get out of impoundment is with one of the "get out of impoundment free" cards. If the player draws this card while in impoundment, he not only leaves the impoundment lot, but he also receives a refund of the $50 fee paid upon entering impoundment. Upon leaving impoundment, the player always returns to his own start position.

Upon entering a town from the perimeter, the player may enter on any color. Thus, the player may take the full count of both dice or he may split the move. However, if that town's double color is rolled and the player enters the town on that roll, that car must be moved the full count of both dice.

A player establishes credit with the bank by making payments on his cars. Each color coded car payment card has a loan value printed on the back. Thus, if a player has made car payments and he is unable to pay any of the fines or penalties assessed by one of the cards or spaces, he may borrow from the bank. The car payments must be made in full, however, before the player can obtain title to the car. If a player runs out of money and is unable to obtain a loan from the bank, and receives a debt that he cannot pay, he is considered bankrupt. If that player wishes to continue in the game, he may return his cars to his town's parking lot and receive $2,000 and start over.

Once a player has managed to pay for and obtain "Title" to all of his cars, he must return to his color town. Then he may roll only one die, and must roll his color in order to return his car to his parking lot. When all three cars have been returned to the "Parking Lot", that player has won the game.

While the invention has been illustrated and described in what is considered to be the most practical and preferred embodiment, it will be recognized that many variations may be made therein without departing from the spirit and scope of the invention as defined by the appended claims.

Having thus described the invention, what is claimed is:

1. A board game apparatus, comprising:

a game board having a plurality of separate and distinct playing areas designated thereon, including a peripheral playing path extending around the perimeter of the board and a plurality of separate and distinct inner playing paths spaced inwardly from the peripheral playing path, each playing path being divided into a plurality of movement spaces variously representing benefit or detriment to the player, and said inner playing paths representing home bases for each player;

a plurality of movement pieces for movement along the playing paths, said movement pieces being distinctively marked for each player;

the movement spaces including a plurality of money spaces located on the peripheral playing path and at least one bank space located in each inner playing path, there being at least one of said money spaces located after each of the bank spaces in the direction of playing piece movement;

a pair of dice, each die having distinctive marks on various faces thereof, said distinctive marks including differing numerical indicia and a second indicia different from the numerical indicia, each face of said die having said numerical indicia and said second indicia located thereon; and the arrangement of the numerical indicia and the second indicia being such that the maximum possible numerical indicia displayed when both dice display the same second indicia is equal to the number of movement spaces between said bank space and said money space located thereafter and thereby providing the only capability of moving from said bank space to said money space located thereafter in one turn.

2. A board game as in claim 1, wherein:

the movement pieces are miniature cars, representing automobiles;

the peripheral playing path represents a highway; and the inner playing paths represent towns.

3. A board game as in claim 2, wherein:

the movement pieces and towns are color coded, there being a plurality of identically colored movement pieces for each player.

4. A board game as in claim 3, wherein:

said differing numerical indicia comprises spots and the dice have different numbers of spots on the different panels thereof; and said second indicia comprises colors and the panels being of different colors, corresponding to the colors of the movement pieces and towns.

5. A board game as in claim 4, wherein:

said money spaces are uniformly spaced apart and represent spaces at which a player receives money.

6. A board game as in claim 5, wherein:

each said bank space is located equidistantly between two of the uniformly spaced "money" spaces on the peripheral playing path.

7. A board game as in claim 6, wherein:

each die of the pair of dice has three different color panels, with opposite panels being the same color; and like color panels on one die having an even number of spots, while the same color panels on the other die have an odd number of spots.

8. A board game as in claim 1, wherein:

said differing numerical indicia comprises spots and said second indicia comprises colors.

9. A board game as in claim 8, wherein:

each die of the pair of dice has three different color panels, with opposite panels being the same color; and like color panels on one die having an even number of spots, while the same color panels on the other die have an odd number of spots.

10. A board game as in claim 9, wherein:

the spots on each panel range in number from one to four.

11. A board game apparatus as claimed in claim 1, including:

a plurality of play variation cards having indicia thereon corresponding to at least some of the movement spaces and having directions governing the detriment or benefit to be accorded a playing piece resting on a designated movement space.

12. A board game apparatus, comprising:

a game board having a plurality of separate and distinct playing areas designated thereon, including a peripheral playing path extending around the perimeter of the board and a plurality of separate and distinct inner playing paths spaced inwardly from the peripheral playing path, each playing path being divided into a plurality of movement spaces variously representing benefit or detriment to the player, and said inner playing paths representing home bases for each player;

a plurality of movement pieces for movement along the playing paths, said movement pieces being distinctively marked for each player;

the movement spaces in each inner playing path including a number of spaces representing benefit to the player and a number of intervening spaces representing detriment to the player;

a pair of dice, each die having distinctive marks on various faces thereof, said distinctive marks including differing numerical indicia and a second indicia different from the numerical indicia, each face of said die having said numerical indicia and said second indicia located thereon; and the arrangement of the numerical indicia and the second indicia being such the maximum possible numerical indicia displayed on a single die is equal to the number of movement spaces between the spaces representing benefit to the player, thereby providing the only capability of moving from one space representing benefit to the next following space representing benefit in one turn when only said one die displays the second indicia corresponding to that inner playing path.

13. A board game apparatus, comprising:

a game board having a plurality of separate and distinct playing areas designated thereon, including a peripheral playing path extending around the perimeter of the board and a plurality of separate and distinct inner playing paths spaced inwardly from the peripheral playing path, each playing path being divided into a plurality of movement spaces variously representing benefit or detriment to the player, and said inner playing paths representing home bases for each player;

a plurality of movement pieces for movement along the playing paths, said movement pieces being distinctively marked for each player;

a pair of dice, each die having distinctive marks on various faces thereof, said distinctive marks including differing numerical indicia and a second indicia different from the numerical indicia, each face of the die having said numerical indicia and said second indicia located thereon;

the movement spaces including a plurality of money spaces located on the peripheral playing path and at least one bank space located in each inner playing path, there being at least one of said money spaces located after each of the bank spaces in the direction of playing piece movement; and the arrangement of the numerical indicia and the second indicia being such that the maximum possible numerical indicia displayed when both dice display the same second indicia is equal to the number of movement spaces between said money spaces on the peripheral playing path and also being equal to the number of movement spaces between the bank space in the inner playing path and the next following money space on the peripheral playing path.

* * * * *